US009480347B2

(12) United States Patent
Strassburger et al.

(10) Patent No.: US 9,480,347 B2
(45) Date of Patent: Nov. 1, 2016

(54) JEWELRY DISPLAY HANGER WITH CABLE TIE

(71) Applicant: B&G Plastics, Inc., Union, NJ (US)

(72) Inventors: Jake Strassburger, South Plainfield, NJ (US); Daniel V. Cunneen, Waldwick, NJ (US); Keith C. Cedro, Clifton, NJ (US)

(73) Assignee: B&G PLASTICS, INC., Union, NJ (US)

( * ) Notice: Subject to any disclaimer, the term of this patent is extended or adjusted under 35 U.S.C. 154(b) by 0 days.

(21) Appl. No.: 14/834,994

(22) Filed: Aug. 25, 2015

(65) Prior Publication Data

US 2016/0058208 A1 Mar. 3, 2016

Related U.S. Application Data

(60) Provisional application No. 62/043,138, filed on Aug. 28, 2014.

(51) Int. Cl.

| | |
|---|---|
| ***A47F 5/00*** | (2006.01) |
| ***B65D 63/10*** | (2006.01) |
| ***B65D 63/04*** | (2006.01) |
| ***B65D 73/00*** | (2006.01) |
| *A47F 7/02* | (2006.01) |

(52) U.S. Cl.

CPC ..... *A47F 5/0006* (2013.01); *B65D 63/04* (2013.01); *B65D 63/1027* (2013.01); *B65D 73/0064* (2013.01); *A47F 7/02* (2013.01); *B65D 2563/108* (2013.01)

(58) Field of Classification Search

CPC ..... A47F 5/0006; A47F 7/02; B65D 63/04; B65D 63/027; B65D 2563/108; E05B 69/00

USPC ..... 248/309.1, 349, 317; 70/57.1

See application file for complete search history.

(56) References Cited

U.S. PATENT DOCUMENTS

| | | | | |
|---|---|---|---|---|
| 4,634,005 | A * | 1/1987 | Kulzer | B65D 73/0064 206/349 |
| 4,714,156 | A | 12/1987 | Kolton et al. | |
| 4,765,467 | A | 8/1988 | Kolton et al. | |
| 4,768,649 | A | 9/1988 | Kolton et al. | |
| 4,930,692 | A | 6/1990 | Smilow et al. | |
| 5,110,019 | A | 5/1992 | Kolton et al. | |
| 5,123,577 | A | 6/1992 | Kolton et al. | |
| 5,222,638 | A | 6/1993 | Kolton et al. | |
| 5,328,065 | A | 7/1994 | Kolton et al. | |
| 5,501,378 | A | 3/1996 | Kolton et al. | |
| 5,582,387 | A | 12/1996 | Kolton et al. | |
| 5,615,810 | A | 4/1997 | Kolton et al. | |
| 5,826,760 | A | 10/1998 | Kolton et al. | |
| 5,988,462 | A | 11/1999 | Kolton | |
| 6,206,253 | B1 | 3/2001 | Kolton et al. | |

(Continued)

*Primary Examiner* — Nkeisha Smith

(74) *Attorney, Agent, or Firm* — Hoffmann & Baron, LLP

(57) ABSTRACT

A jewelry display hanger is provided that includes a hook, a body connected to a housing by a neck and a cable tie or a twist tie. The hook extends from the first end of the body and the neck extends from the second end. The housing is elongated with first and second ends and a passage extending therebetween. The elongated housing is connected to the body by the neck. The cable tie or twist tie has a first end and a second end. The first end of the cable tie or twist tie passes through the passage in the housing and is connected to the second end to form a loop for attaching the hanger to an article of jewelry.

18 Claims, 1 Drawing Sheet

(56) References Cited

U.S. PATENT DOCUMENTS 6,241,208 B1 * 6/2001 Lin ..... B65D 73/0014 206/349
6,264,077 B1 7/2001 Kolton et al.
6,425,482 B1 * 7/2002 Chiang ..... G03F 7/0758 206/349
6,561,358 B2 5/2003 Kolton et al.
6,827,210 B2 * 12/2004 Chen ..... B65D 73/00 206/349
7,143,892 B2 12/2006 Kolton et al.
7,183,914 B2 * 2/2007 Norman ..... G09F 3/14 340/568.1
7,210,663 B2 * 5/2007 Wheeler ..... A47F 5/0006 206/349
7,448,520 B2 11/2008 Kolton et al.
7,648,029 B2 * 1/2010 Chen ..... A47F 5/0006 206/376
8,261,912 B1 * 9/2012 Ingrey-Senn ..... A47F 5/0006 206/349
8,286,882 B2 10/2012 Norman et al.
8,308,291 B2 * 11/2012 Norman ..... A47F 5/0006 24/3.3
8,322,529 B2 * 12/2012 Titkos ..... B65D 73/0064 206/471
8,337,016 B2 * 12/2012 Liebers ..... A47F 5/0006 248/902
8,590,699 B2 * 11/2013 Feibelman ..... G09F 3/037 206/6.1
8,651,344 B2 2/2014 Norman et al.
8,759,678 B2 * 6/2014 Filatov ..... H04Q 1/06 174/135
D711,658 S * 8/2014 Pelton ..... A47G 25/28 D6/315
2002/0148746 A1 * 10/2002 Eriksson ..... B26B 29/00 206/349
2005/0056754 A1 * 3/2005 Salani ..... E06C 7/14 248/309.1
2005/0230587 A1 * 10/2005 Yang ..... B65D 73/0064 248/314
2008/0197244 A1 * 8/2008 Bechmann ..... G09F 3/14 248/74.3
2009/0065386 A1 * 3/2009 Hasegawa ..... A47F 5/0006 206/349
2014/0075725 A1 * 3/2014 Feibelman ..... G09F 3/037 24/481

* cited by examiner

JEWELRY DISPLAY HANGER WITH CABLE TIE

This application claims priority from provisional application Ser. No. 62/043,138, filed on Aug. 28, 2014, which is incorporated herein in its entirety.

FIELD OF THE INVENTION

The present invention relates to hangers that are used in the packaging and display of jewelry. In particular, the present invention relates to hangers that are secured to one or more pieces of jewelry with a cable tie and hung from merchandise displays.

BACKGROUND OF INVENTION

Small articles, such as jewelry, are commonly displayed for sale in retail stores on racks or in display cases where the articles are hung. A variety of different hangers and tags have been used that are secured to the article and have a means for attaching the article to the rack for display. Several of the criteria for designing these hangers relate to the cost of manufacturing the hangers and the cost of attaching them to the articles. Another important design consideration is that the hangers must be convenient for the merchant to display and they must be convenient for the customer to remove after purchase.

Hangers used for displaying large pieces of jewelry, such as bracelets, broaches and necklaces, must be designed so that the customer can easily view the jewelry and remove the hanger from the display rack. The hangers must also be designed so that the customer can easily remove the hanger to try on the jewelry. Because a customer may try on several pieces of jewelry before making a selection, the hangers must be designed so that they can be removed and then reinstalled on the rack by the customer numerous times without damaging either the jewelry or the hangers. Moreover, large pieces of jewelry require attachment devices that can accommodate their large size.

Accordingly, there is a need for a hanger for displaying large pieces of jewelry that can be easily removed and reinstalled in the display and that does not prevent the jewelry from being worn by a customer. There is also a need for a hanger for displaying jewelry that can be economically manufactured and easily and firmly secured to the jewelry.

SUMMARY OF THE INVENTION

In accordance with the present invention, a jewelry display hanger with a cable tie or a twist tie is provided. The jewelry display hanger comprises, consists of or consists essentially of a hook, a body connected to a housing by a neck and a cable tie. The body is substantially flat and has front and rear surfaces, a longitudinal axis, first end and second ends and two sides. The hook extends from the first end of the body along the longitudinal axis and the neck extends along the longitudinal axis from the second end. Preferably, the body has a trapezoidal shape with the two sides extending outwardly from the longitudinal axis between the first end and the second end.

The housing is elongated with first and second ends and a passage extending therebetween; preferably, the passage is perpendicular to the longitudinal axis and the housing has two substantially flat sides that are parallel to the surfaces of the body. In addition, the housing can have one or more apertures extending through the two flat sides and perpendicular to the longitudinal axis. The elongated housing is connected to the body by the neck. The jewelry display hanger can include first and second recesses formed on the opposing sides of the hanger between the elongated housing and the second end of the body.

The cable tie or twist tie has a first end and a second end. The first end is inserted through the passage or the one or more apertures in the housing and connected to the second end to form a loop for attaching the hanger to an article of jewelry. The first end of the cable tie passes through the passage in the housing and is inserted in the locking device to form a loop for attaching the hanger to an article of jewelry. The first end of the cable tie preferably has a plurality of transverse ridges that are engaged by a locking device on the second end. Preferably, the cable tie locking device cannot be unlocked. This provides a security feature and makes it more difficult for a shoplifter to detach the hanger from the item of jewelry. When a twist tie is used, after the first end passes through the housing and around the piece of jewelry, the first end and the second end are connected by twisting them together.

BRIEF DESCRIPTION OF THE FIGURES

The preferred embodiments of the jewelry display hanger with a cable tie of the present invention, as well as other objects, features and advantages of this invention, will be apparent from the accompanying drawings wherein.

DETAILED DESCRIPTION OF THE INVENTION

The present invention is a jewelry display hanger with a cable tie that can be used for displaying a variety of pieces of jewelry having different sizes and shapes. The jewelry display hanger includes a substantially flat body having front and rear surfaces with a hook on one end that is used to attach the hanger to a display. The front and rear surfaces of the body can include logos, product descriptions or pricing information, including bar codes. The hanger body has a trapezoidal shape with the two sides extending downwardly and away from the hook end of the hanger to the second end. A neck extends from the second end and connects the body of the hanger to an elongated housing that is parallel to the second end of the hanger and has first and second ends and a passage extending therebetween. The housing has two substantially flat sides that are parallel to the surfaces of the body and opposing ends that extend away from the neck.

A cable tie with a substantially flat first end having a surface with transverse ridges (i.e., ridges or raised portions of the surface that are perpendicular to the longitudinal axis of the cable tie) and a second end with a locking device is inserted in the passage. Typically, the cable tie is made from a plastic or nylon material. The first end of the cable tie is inserted into the passage at one of the ends of the housing and exits through to the opposing end. The cable tie is then inserted in the locking device to form a loop for attaching the hanger to an article of jewelry. Preferably, the cable tie locking device cannot be unlocked. For example, the first end of the cable tie can have a plurality of ribs transverse to the length of the cable tie. The ridges extend from the surface of the cable tie in a direction from the first end towards the second end. When the first end of the cable tie is inserted into the locking device on the second end, the ridges are slanted in a direction away from the direction of movement of the first end so the cable tie easily passes through the locking device. However, if the user attempts to move the cable tie in the opposite direction, the ridges engage the locking device and prevent the cable tie from moving. In order to remove the cable tie from the hanger, the cable tie has to be cut. In another embodiment, a twist tie can be used to secure the piece of jewelry in the hanger. One end of the twist tie is inserted through the passage or the one or more apertures in the housing and then passed around a piece of jewelry. The two ends of the twist tie are then joined together and twisted together to secure the jewelry to the hanger. The design of the cable tie or the twist tie is not intended to limit the invention and the use of any one of a variety of well-known cable ties is contemplated by this invention.

Figure 3:
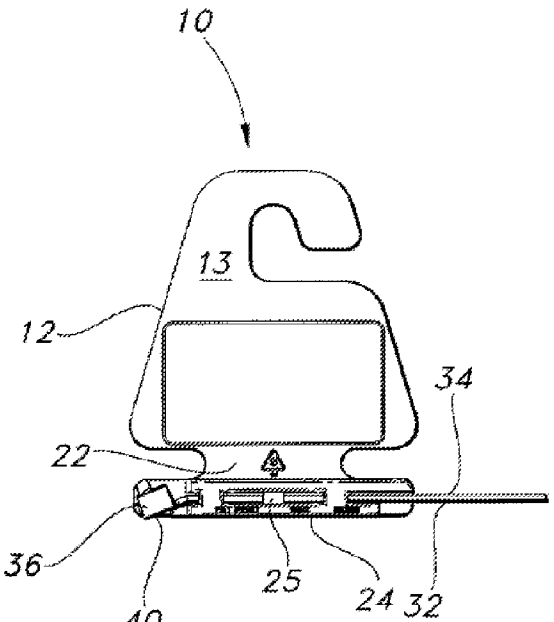
FIG. 3 is a rear view of the jewelry display hanger with a cable tie shown in FIG. 1.
Figure 2:
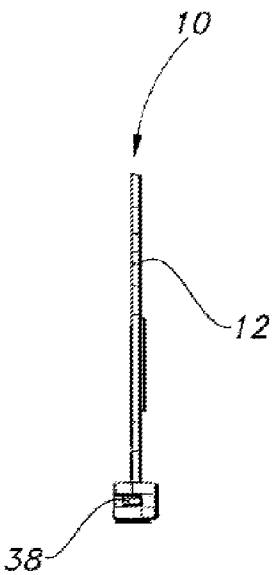
FIG. 2 is a side view of the jewelry display hanger with a cable tie shown in FIG. 1.
Figure 1:
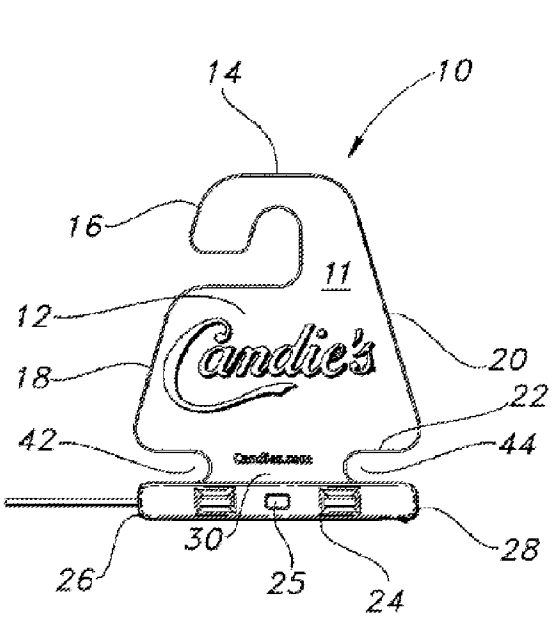
FIG. 1 is a front view of a first embodiment of the jewelry display hanger with a cable tie having a hook, a body with a housing opposite the hook for receiving a cable tie therethrough.
Figure 4:
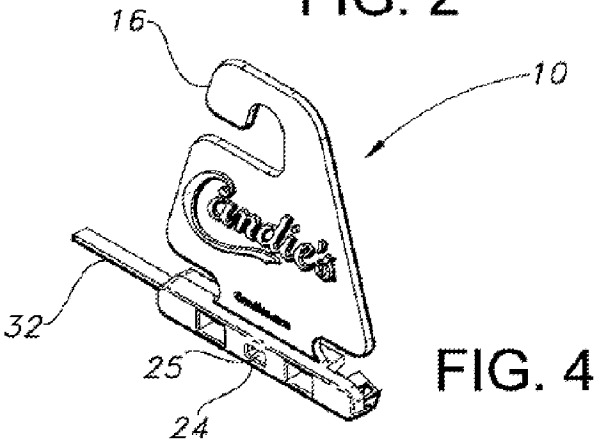
FIG. 4 is a perspective view of the jewelry display hanger with a cable tie shown in FIG. 1.

Referring now to the drawings, FIGS. 1-4 show a front view, side view, rear view and perspective view, respectively of an embodiment of the jewelry display hanger 10. The hanger 10 has a body 12 with front and rear surfaces 11, 13, a first end 14 formed by a hook 16 and two opposing sides 18, 20 that extend downwardly and outwardly to a second end 22. A housing 24 having one or more apertures 25, a first end 26 and a second end 28 is connected to the second end 22 of the body 12 by a neck 30. A cable tie 32 having a first end 34 and a second end 36 is inserted through the one or more apertures 25 or a passage 38 in the housing 24 that extends between the first and second ends 26, 28. After the first end 34 of the cable tie 32 passes through the housing 24, it can be passed through or around an article of jewelry and secured to a locking device 40 on the second end 36 of the cable tie 32.

First and second recesses 42, 44 on opposing sides 18, 20 of the hanger 10 are formed between the elongated housing 24 and the second end 22 of the body 12. The recesses 42, 44 can be used to support an article of jewelry attached to the hanger 10.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A jewelry display hanger comprising:

a substantially flat body having front and rear surfaces, a longitudinal axis extending between a first end and a second end, a hook on the first end, and a perimeter formed by the first end, the second end and two sides extending therebetween;

a substantially flat neck coplanar with the body and extending along the longitudinal axis from the second end;

an elongated housing connected to the body by the neck and having first and second side walls with one or more apertures therethrough, first and second ends and a passage extending therebetween, wherein the passage is perpendicular to the longitudinal axis of the body, and wherein the first and second side walls of the elongated housing are parallel to the front and rear surfaces of the body; and a cable tie or a twist tie having a first end and a second end, wherein the first end is inserted through the one or more apertures or the passage in the housing and is connected to the second end to form a loop for attaching the hanger to an article of jewelry, wherein the second end of the cable tie comprises a locking device and the first end of the cable tie is inserted in the locking device or the first end and second end of the twist tie are twisted together to secure the article of jewelry to the hanger.

2. The jewelry display hanger according to claim 1 further comprising first and second recesses between the elongated housing and the second end of the body, wherein the neck is disposed between the first and second recesses.

3. The jewelry display hanger according to claim 1, wherein the two sides of the substantially flat body extend outwardly from the longitudinal axis between the first end and the second end of the substantially flat body.

4. The jewelry display hanger according to claim 1, wherein the cable tie locking device cannot be unlocked.

5. The jewelry display hanger according to claim 1, wherein the neck is connected to the elongated housing at a point intermediate the first and second ends.

6. The jewelry display hanger according to claim 1, wherein the body has a trapezoidal shape.

7. The jewelry display hanger according to claim 1, wherein the neck has a transverse width that is less than a distance between the two sides of the body.

8. A jewelry display hanger comprising:

a substantially flat body having front and rear surfaces, a longitudinal axis extending between a first end and a second end, a hook on the first end, and a perimeter formed by the first end, the second end and two sides wherein the two sides extend outwardly from the longitudinal axis between the first end and the second end;

a substantially flat neck coplanar with the body and extending along the longitudinal axis from the second end;

an elongated housing connected to the body by the neck and having four side walls, first and second ends and a passage extending therebetween, wherein the passage is perpendicular to the longitudinal axis, and wherein two of the side walls are parallel to the front and rear surfaces of the body; and a cable tie or a twist tie having a first end and a second end, wherein the first end is inserted through the passage in the housing and is connected to the second end to form a loop for attaching the hanger to an article of jewelry, wherein the second end of the cable tie comprises a locking device and the first end of the cable tie is inserted in the locking device or the first end and second end of the twist tie are twisted together to secure the article of jewelry to the hanger.

9. The jewelry display hanger according to claim 8 further comprising first and second recesses between the elongated housing and the second end of the body.

10. The jewelry display hanger according to claim 8, wherein the cable tie locking device cannot be unlocked.

11. The jewelry display hanger according to claim 8, wherein the neck is connected to the elongated housing at a point intermediate the first and second ends.

12. The jewelry display hanger according to claim 8, wherein the body has a trapezoidal shape.

13. The jewelry display hanger according to claim 8, wherein the neck has a transverse width that is less than a distance between the two sides of the body.

14. A jewelry display hanger comprising:

a substantially flat body having front and rear surfaces, a longitudinal axis extending between a first end and a second end, a hook on the first end, and a perimeter formed by the first end, the second end and two sides wherein the two sides extend outwardly from the longitudinal axis between the first end and the second end;

a substantially flat neck coplanar with the body and extending along the longitudinal axis from the second end;

an elongated housing connected to the body by the neck and having two side walls parallel to the front and rear surfaces of the body, first and second ends and a passage extending therebetween, wherein the passage is perpendicular to the longitudinal axis;

first and second recesses formed on the opposing sides of the hanger between the elongated housing and the second end of the body; and a cable tie or a twist tie having a first end and a second end, wherein the first end is inserted through the passage in the housing and is connected to the second end to form a loop for attaching the hanger to an article of jewelry, wherein the second end of the cable tie comprises a locking device and the first end of the cable tie is inserted in the locking device or the first end and second end of the twist tie are twisted together to secure the article of jewelry to the hanger.

15. The jewelry display hanger according to claim 14, wherein the cable tie locking device cannot be unlocked.

16. The jewelry display hanger according to claim 14, wherein the neck is connected to the elongated housing at a point intermediate the first and second ends.

17. The jewelry display hanger according to claim 14, wherein the body has a trapezoidal shape.

18. The jewelry display hanger according to claim 14, wherein the neck has a transverse width that is less than a distance between the two sides of the body.

* * * * *